US005627506A

United States Patent [19]

Suzuki

[11] Patent Number: 5,627,506

[45] Date of Patent: May 6, 1997

[54] OVERLOAD PROTECTOR

[75] Inventor: Satoru Suzuki, Shizuoka-ken, Japan

[73] Assignee: Texas Instruments Incorporated, Dallas, Tex.

[21] Appl. No.: 384,178

[22] Filed: Feb. 6, 1995

[30] Foreign Application Priority Data

Feb. 8, 1994 [JP] Japan ..... 6-035493

[51] Int. Cl.[6] ..... H01H 37/00

[52] U.S. Cl. ..... 337/298; 337/307

[58] Field of Search ..... 337/298, 299, 337/303, 304, 307, 309, 310, 311

[56] References Cited

U.S. PATENT DOCUMENTS 4,472,705 9/1984 Carlson ..... 337/299
4,724,414 2/1988 Kurz ..... 337/383

*Primary Examiner*—Lincoln Donovan
*Attorney, Agent, or Firm*—Russell E. Baumann; Richard L. Donaldson; Rene'E. Grossmann

[57] ABSTRACT

An overcurrent protection device for a load 24 having a housing 100 with fixed contacts 108, 110, movable contacts 118, 120 and terminals 102, 104 for electrical connection to the load. A first snap acting bimetallic 116 member in the device is responsive to heat from overcurrent conditions at a first snap temperature and a second snap acting bimetallic member 12 is responsive to heat at a second higher temperature in the event of failure in operation of the first bimetallic member. The first bimetallic member 116 controls the movement of the movable contacts 118, 120 to cause engagement and nonengagement with the stationary contacts 108, 110, and the second snap acting bimetallic member 12 controls electrical connection between the fixed contact 102 and terminal 108, and is not resetable upon breaking the electrical connection. Additionally, a heat conductive member 20 of high heat conductivity is provided that directly provides superior heat conductivity between the load 24 and the first bimetal member 116 so that the bimetal more accurately reflects the temperature of the load.

13 Claims, 4 Drawing Sheets

OVERLOAD PROTECTOR

FIELD OF THE INVENTION

This invention is related to an overload protection device for protecting electric devices from overcurrent conditions, over heating and the like.

BACKGROUND OF THE INVENTION

Prior art overcurrent protection devices, as shown in FIG. 6, are typically employed in a sealed compressor unit for a freezer or the like.

This device has a cylindrically-shaped casing 100 made of an insulating material with one open side of casing 100 which is placed directly against the housing of a compressor 124. First, second and third external connection terminals 102, 104 and 106 protrude from an opposite closed side 100*a* of casing 100. First and second external connection terminals 102 and 104 are integrally formed with a pair of fixed contacts 108 and 110 respectively provided within casing 100, and third external connection terminal 106 is connected to fixed contact 110 through a resistance heater 112 that is contained within casing 100.

At the center of the upper closed side 100*a* of the casing 100, a bolt 114 made of brass or the like is contained vertically in the casing extending both inside and outside of casing 100 and a disk-shaped bimetal 116 is attached by means of a rivet 115 or the like at the lower side of bolt 114 within casing 100. On the upper side of the bimetal 116, movable contacts 118 and 120 are welded at the locations which correspond to the fixed contacts 108 and 110 respectively.

At a time of normal operation, the bimetal 116 is located at a first position where the peripheral part of the disk bends upward with the center of the disk as the fulcrum so as to elastically compress the movable contacts 118 and 120 into contact with fixed contacts 108 and 110, thereby maintaining the switch circuit in a closed state. In this closed state, the electric current that has entered from the second or third external connection terminal 104 and 106 flows from the fixed contact 110 to the external connection terminal 102 through a movable contact 120, bimetal 116, movable contact 118 and the fixed contact 108.

FIG. 7 typically shows the construction of the above referred to overload protection device in an electric circuit. The first external connection terminal 102 is electrically connected to one terminal of an electric source 122; and a motor 126 in, for example, a compressor 124 is connected electrically between the other end of the electric source 122 and the third external connection terminal 106. In the case where it is not possible to provide resistance heater 112 inside casing 100, a terminal 126*b* of the motor 126 is electrically connected to second external connection 104.

When the switch is in a closed state, the electric current that flows to the motor 126 also flows to the bimetal 116 and heating resistor 112, with the bimetal 116 being heated by resistance heating caused by the current flowing through it and also by the heat from resistance heater 112. In addition, the bimetal 116 is also heated by the radiant heat from the compressor 124; however, the extent of this radiant heating is small as compared with the heating caused by resistance heating.

The ordinary case where motor 126 of compressor 124 requires protection is the case where the electric current has exceeded a certain rated value due to an overload or locked rotor state. In such a case, typically the cooling ability of a condenser (which is not shown in the drawing) is reduced and therefore the amount of the work on the compressor 124; and thus, the load on the motor 126 becomes excessive. This condition results in a current overflow and the possibility of damage to motor coils. Also, in the case where the operation of the compressor 124 is started again immediately after its stoppage, there is a possibility that the piston is not able to compress the coolant gas if there is a stagnant coolant gas at high temperature and under high pressure on the output side. This condition also causes the motor to demand abnormally high current.

When the electric current that flows to the motor 126 increases as described above, there is an increase in the heat due to resistance heating within the bimetal 116 with the result that the temperature of the bimetal 116 rises. When it rises to a prescribed first action temperature such as 160 degrees centigrade for example, the bimetal 116 snaps over center thereby being displaced to the second position where the peripheral part of the disk bends downward as is shown by the dotted line 116' in FIGS. 6 and 7. In this position, the movable contacts 118 and 120 that are fixed to the top of the bimetal 116 become separated from the fixed contacts 108 and 110 respectively with a result that the switch circuit is opened and the electric current is shut off. Due to this current shut-off, the possible damage to the coils of the motor 126 is prevented.

When the electric current is shut off, the heating within the bimetal 116 stops. When the bimetal 116 is cooled to the prescribed second action temperature such as, for instance, 80 degrees centigrade, the bimetal 116 snaps and moves from the second position back to the first position thereby closing the switch circuit. Due to this movement of the bimetal, the electric current once again flows and the operation of the compressor 124 is re-started.

Certain problems may occur with these prior art protectors. In operation, the bimetal 116 may gradually wear out as it snaps repeatedly between the first position and the second position. If a crack develops in a bimetal, it typically will no longer snap as desired, even if it is heated to a temperature above the action temperature with the result that the movable contacts 118 and 120 do not move out of contact with fixed contacts 108 and 110. Also, there are cases where even if the bimetal 116 attempts to snap regularly, the movable contacts 118 and 120 become "welded" to the fixed contacts 108 and 110 and are not separated from them. In such cases, there is a need for cutting of the electric current. However, the overload protection device of the prior art, as described above, does not have means for doing so with the result that the electric current continues flowing and that the motor 126 can be damaged due to an overload.

In order to cope with this problem, it has been the case in the past to install a separate thermostat on the compressor with the switch circuit of this thermostat being connected in series with the switch circuit of an overload protection device.

This solution, of course, involves additional cost and handling and installation problems. Further, an overload protection device of the past only responds effectively to an overcurrent, but does not also adequately protect against excessive rise in the temperature of the load. That is, the temperature of the load (compressor 124) is transmitted to the bimetal 116 only in the form of radiant heat through the open lower surface of the casing 100 with the result that the rate of the response to such an excessive rise in the temperature of the load has been slow.

Still further, in the conventional overload protection device, the bimetal 116 typically becomes cooled and returns to the first position before the temperature of the load (compressor 124) has been sufficiently lowered subsequent to a shut-off of the electric current. This can cause insufficient protection of the load or an increase in the number of the actions of the switch thereby shortening the life of the contact mechanism.

Lastly, the overload protection device according to prior art has lacked the easy freedom of adjustment of the values of electric current shut off or overload current protection.

SUMMARY OF THE INVENTION

Accordingly, an objective of the present invention is to provide an overload protective device which is equipped with a small and simple thermostat having an inexpensive construction, and yet capable of accurately shutting off the overcurrent at the time when the contact mechanism has failed.

Another objective of this invention is to provide an overload protection device whose rate of response to an excessive rise in the temperature of the load is quick.

Still another objective of this invention is to provide an overload protection device which is capable of easily changing and adjusting shut off/overcurrent values for the device.

Accordingly, a protector for an electrical load of the present invention comprises a housing, a fixed contact means contained within said housing which is electrically connected to said electrical load through a terminal means, a movable contact means contained within said housing positioned to make contact with said fixed contact means, a first bimetallic element capable of movement between a first position and a second position at a first action temperature in response to heat generated reflecting the electric current level that flows to said load, said first position being where said movable contact means engages said fixed contact means and said second position being where said movable contact means separates from said fixed contact means thereby opening the electrical connection between the protector and the load, and a second auxiliary snap-acting bimetal element capable of movement between a first position and a second position at a second higher action temperature than said first action temperature in the event said first bimetallic element fails to move from the first position to the second position, said first position being where said auxiliary bimetal member electrically connects said fixed contact means and said terminal means and said second position being where said auxiliary bimetal breaks electrical connection between said fixed contact means and said terminal means thereby opening the circuit between the protector and the load.

Further, a protector for an electrical load of the present invention comprises a housing, a fixed contact means contained in said housing which is electrically connected to said electrical load through a terminal means, a movable contact means contained within said housing positioned to make contact with said fixed contact means, a bimetallic element capable of movement between a first closed contacts position in which said movable contact means engages said fixed contact means and a second open contacts position in which said movable contact means separates from said fixed contact means at a predetermined temperature in response to heat generated reflecting the electric current level that flows to said load, and a heat conductive means of high heat conductivity that directly contacts said load and said bimetal member thereby providing for said bimetal member to reflect the temperature of the load.

BRIEF DESCRIPTION OF THE DRAWINGS

Other objects, advantages and details of the motor protection device of this invention appear in the following detailed description of the preferred embodiments of the invention, the detailed description referring to the drawings in which.

DESCRIPTION OF THE PREFERRED EMBODIMENTS

Figure 1:
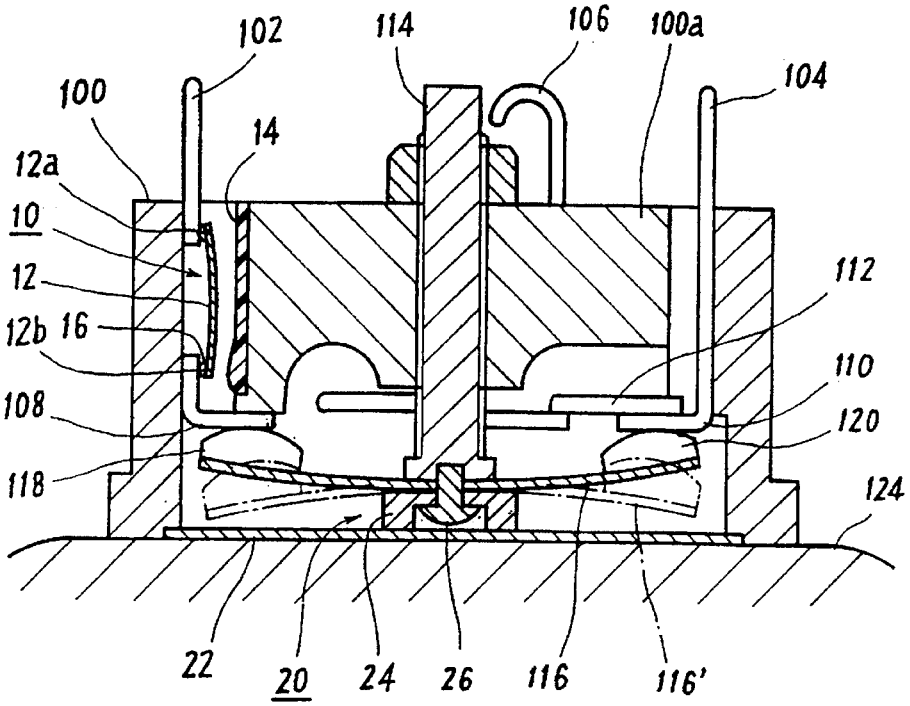
FIG. 1 shows a cross-sectional view of the construction of a protection device according to this invention in which the auxiliary bimetal of the thermostat mechanism is at a first position.
Figure 2:
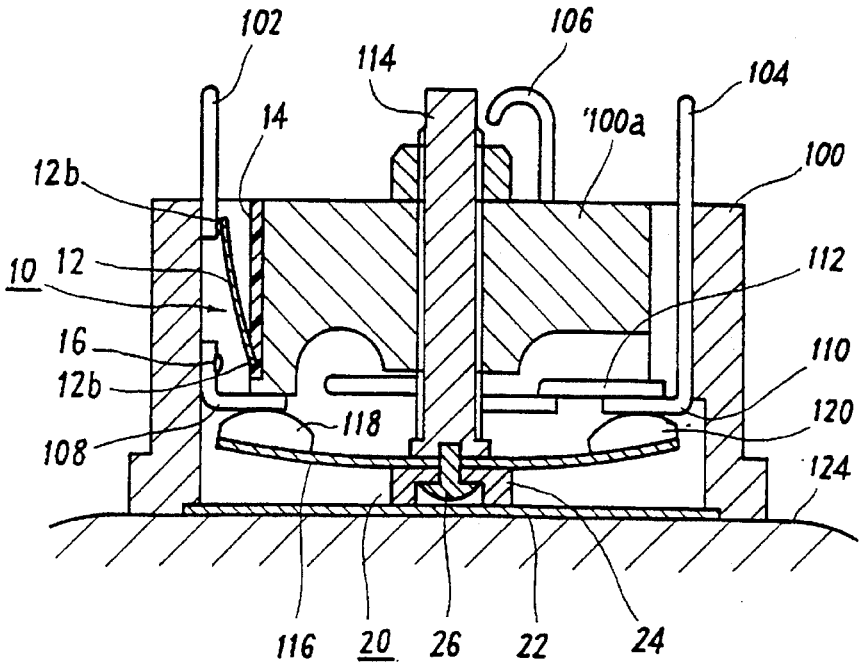
FIG. 2 shows a cross-sectional view of the construction of a protection device shown in FIG. 1 in which the auxiliary bimetal of the thermostat mechanism is at a second position.

FIGS. 1 and 2 show the construction of an overload protection device according to this invention which can suitably be employed for the protection of the motor of the sealed type freezer compressor. In this embodiment, and in other embodiments, those parts which are in common with the various parts of the previously described prior art device (FIGS. 6 and 7) are given the same code.

Figure 6:
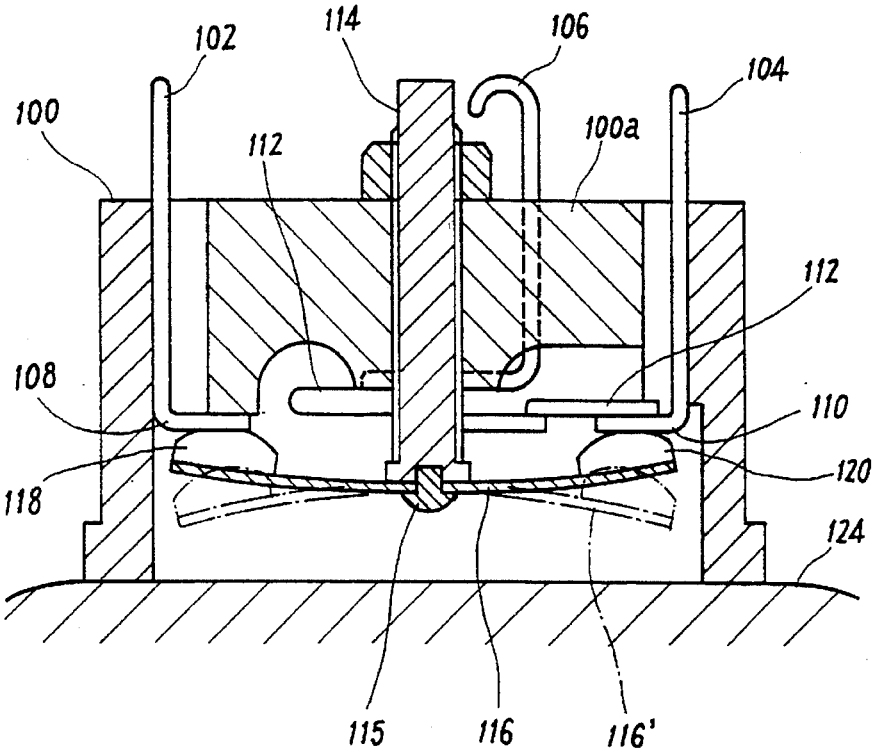
FIG. 6 shows a cross-sectional view of the construction of a protector according to the prior art.
Figure 7:
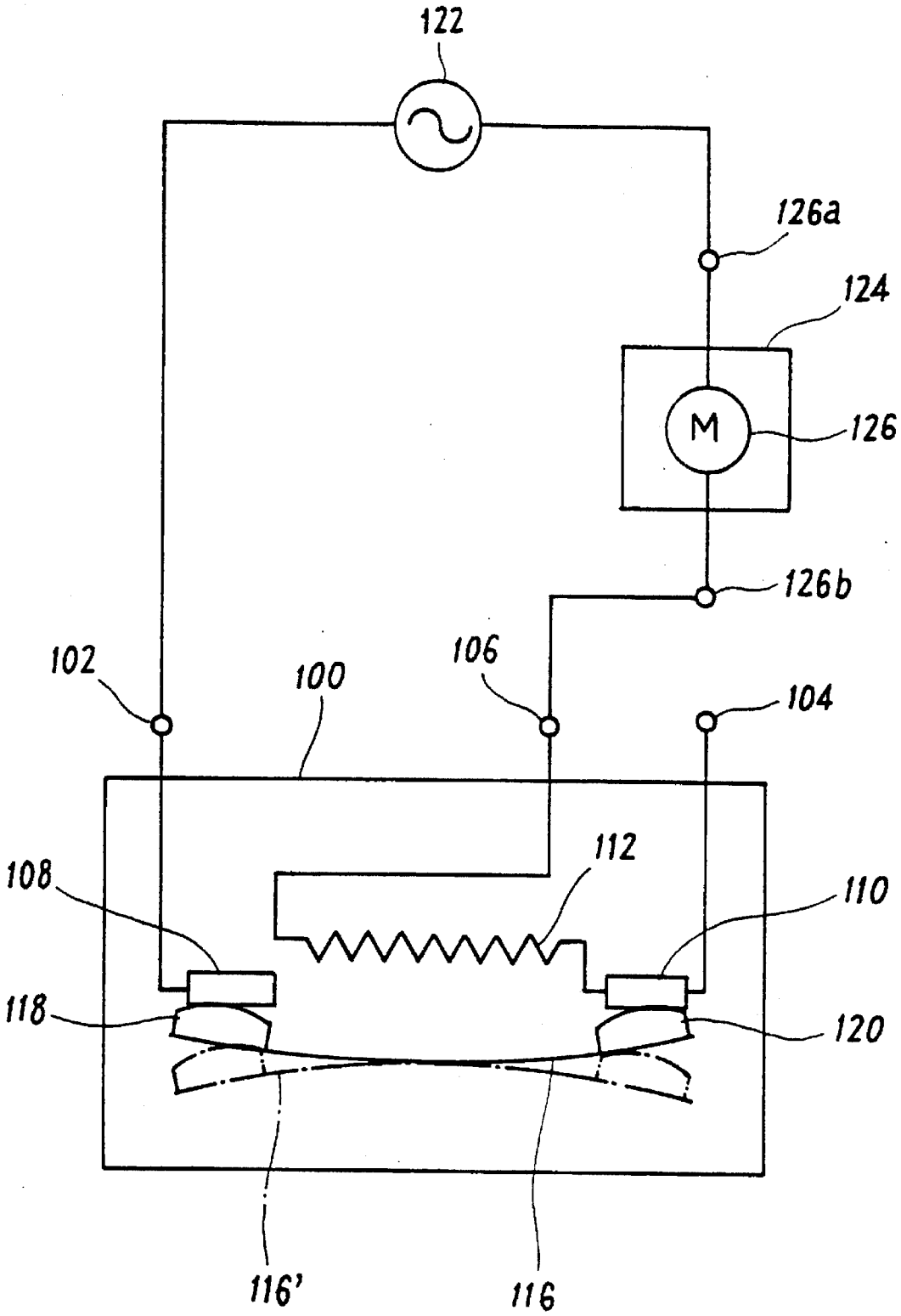
FIG. 7 shows the electrical circuitry of a motor protection system using the protector device of FIG. 6.

An overload protection device according to an embodiment of this invention is constructed by adding a thermostat mechanism 10 for cutting off the overcurrent, and a heat conductive mechanism 20 for transmitting the temperature of the load 24 to the main bimetal 116 to the construction of the device shown in FIG. 6.

Thermostat mechanism 10 comprises an auxiliary bimetal 12 positioned between a first external connection terminal 102 and a fixed contact 108 which are separate elements in casing 100, and a thermoplastic resin member 14 or the like which is provided on a surface of an inner wall of casing 100 facing auxiliary bimetal 12.

Auxiliary bimetal 12 is semi-permanently fixed by resistance welding or the like an upper end **12*a* of bimetal 12 (as shown in FIG. 1) to an end of the terminal 102 within casing 100. The opposite end 12*b* of bimetal 12 is joined by solder 16 or the like to fixed contact 108. At a temperature above a prescribed temperature, the solder melts, the auxiliary bimetal 12 snaps over center and the lower end 12*b* of the auxiliary bimetal 12 is separated from the fixed contact 108 and contacts thermoplastic resin member 14 which is located directly across from bimetal 12**.

The action temperature for the auxiliary bimetal 12 to snap and be displaced conveniently is set at a temperature which is somewhat higher than the action temperature at which a main bimetal 116 snap and is displaced from a first position (contact connection position) to a second position (contact shut-off position). For example, bimetal 116 may be set at 160 degrees centigrade and bimetal 12 may be set at 200 degrees centigrade.

The thermoplastic resin member 14 is made, for example, of Nylon (a Trademark of DuPont) which is made to soften at a temperature above a prescribed temperature such as approximately 160 degrees centigrade, which is somewhat lower than the snap action temperature of the auxiliary bimetal 12. At the time when the auxiliary bimetal 12 has snapped and is displaced, the thermoplastic resin member 14 has already been softened by the radiant heat from auxiliary bimetal 12 and the fixed contact 108. Accordingly, the lower end 12*b* of the auxiliary bimetal 12 contacts thermoplastic resin member 14 in a softened state and consequently becomes buried or sunk in the resin.

Under first normal overload conditions, the main bimetal 116 snaps and is displaced from the first position to the second position at a first prescribed action temperature (approximately 160 degrees centigrade) which is lower than the snap action temperature (approximately 200 degrees centigrade) of the auxiliary bimetal 12 with the movable contacts 118 and 120 separating from the fixed contacts 108 and 110. The auxiliary bimetal 12 does not move and remains connected between the first external connection terminal 102 and the fixed contact 108.

However, under second abnormal overload conditions such as when the contact mechanism of first bimetal 116 fails and an overcurrent flows, the resistance heat of the auxiliary bimetal 12 and the amount of the resistance heat of the surrounding conductors such as the fixed contact 108, etc., become significant so that the temperature of the auxiliary bimetal 12 rises and the solder 16 melts. When bimetal 12 is heated to its snap action temperature (approximately 200 degrees centigrade), the auxiliary bimetal 12 snaps and is displaced with the lower part 12*b* of the auxiliary bimetal 12 being separated from the fixed contact 108 and contacts thermoplastic resin member 14 which is across from it. The thermoplastic resin 14 has already been softened and the lower part 12*b* of the auxiliary bimetal 12 becomes at least partly buried in the resin.

In this second abnormal overload condition, the separation of the auxiliary bimetal 12 from the fixed contact 108 shuts off the electric current and protects the load even in the case of failure mode problems with contacting mechanism.

When the electric current is shut off as described above for second abnormal overload condition, neither the auxiliary bimetal 12 nor the other conductor continue to produce heating and the thermoplastic resin member 14 is gradually cooled and hardens with the auxiliary bimetal 12 being buried therein. That is (as is shown in FIG. 2), the auxiliary bimetal 12 is firmly held in the thermoplastic resin 14 that has been hardened incapable of returning to be in contact with fixed contact 108. Consequently, so long as this failed overload protection device is not replaced by a new one, no electric current will be able to flow to the load.

In this manner, the overload protection device of this embodiment accommodates a small-sized, concise and inexpensive thermostat mechanism 10 which comprises an auxiliary bimetal 12 and a thermostat resin member 14 inside casing 100 to protect the load (compressor 24) by accurately and permanently cutting off the overcurrent at the time when there is a contact mechanism failure.

Figure 3:
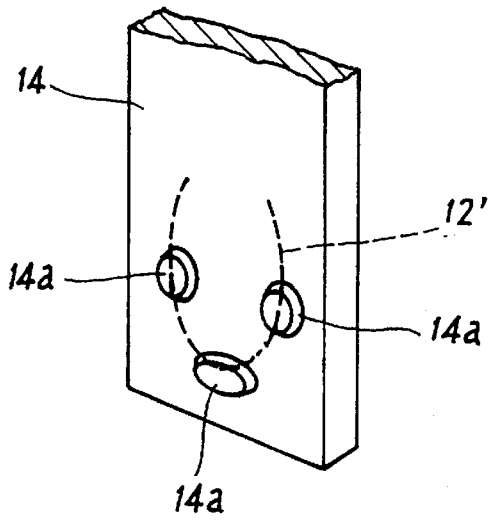
FIG. 3 shows an oblique view of a thermoplastic resin member of the thermostat mechanism of FIG. 1.

If desired, for more reliably retaining of the auxiliary bimetal 12 by thermoplastic resin member 14, it is also possible to provide a single or a plurality of protrusions 14*a* (see FIG. 3) on the surface of the thermoplastic resin member 14 corresponding to the edge(s) of the lower end 12*b* of auxiliary bimetal 12.

A second feature of this present invention will be described below. A heat conductive mechanisms 20 is provided in direct heat conductivity relationship with bolt 114. This heat conductive mechanism 20 comprises a cover-shaped heat conductive plate 22 which is installed on the lower surface of casing 100 that contacts the main load body 124 and a heat conductive member 24 which thermally connects heat conductive plate 22 and the center of main bimetal 116.

Heat conductive plate 22 is made of a material whose heat conductivity is high and which is electrically insulating such as a polyimide film, and is placed in direct contact with the main load body 124. Heat conductive member 24 is made of a metal whose heat conductivity is high such as copper and is fixed to the lower end of a bolt 114 by means of a rivet 26 or the like in such a manner as to sandwich the center of the main bimetal 116 therebetween. Heat conductive member 24 is in direct contact with the heat conductive plate 22.

With the use of conductive mechanism 20, the heat of the main load body 124 is quickly reflected by heat conductive plate 22 and in turn is then transmitted to the main bimetal 116. The heat mainly flows to the center of main bimetal 116 by heat conductance through the heat conductive plate 22 and the heat conductive member 24 to be dispersed to the various parts of the bimetal.

As the temperature of the main load (compressor 124) body is quickly and effectively transmitted to the main bimetal 116 in this manner, the rate of the response of the main bimetal 116 to an excessive rise in the temperature of the load is improved and the electric current will typically be shut off in a shorter period of time.

Figure 4:
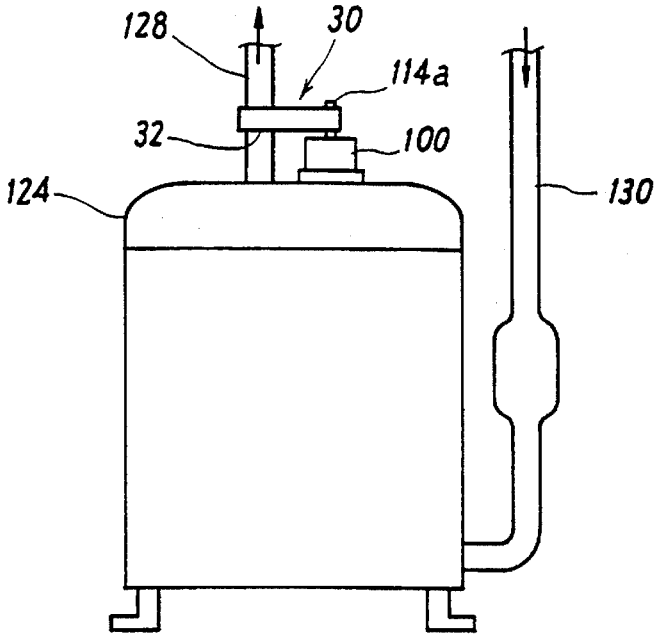
FIG. 4 shows a diagrammatical side view of a construction of a compressor with an overload protection device and a first heat conductive mechanism.
Figure 5:
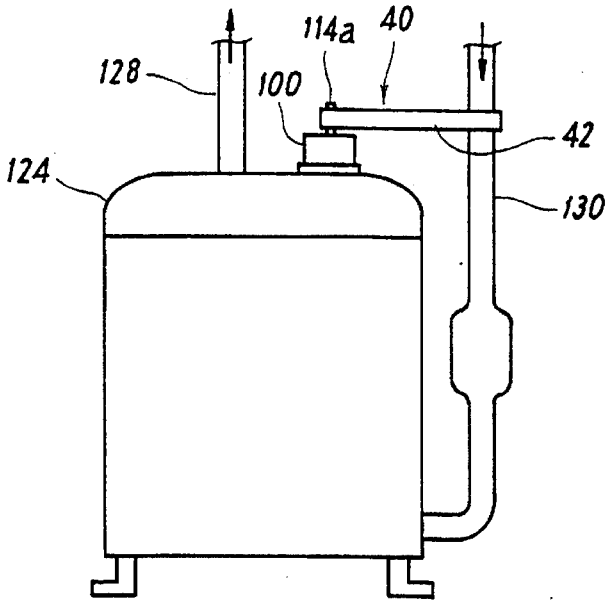
FIG. 5 shows a diagrammatical side view of a construction of a compressor with an overload protection device and a second heat conducted mechanism.

FIGS. 4 and 5 show the constructions of heat conductive mechanisms in different embodiments of the present invention. These heat conductive mechanisms can be added to the overload protection device (refer to FIGS. 1 and 2) in the aforementioned example, but may also be used in prior art devices as shown in FIG. 6.

A heat conductive mechanism 30, as shown in FIG. 4, is formed by a bolt 114 that supports a main bimetal 116 and protrudes a length up from the upper surface of casing 100. A strip heat conductive member 32 made of zinc-plated copper or the like has a first end that engages a bolt protrusion part 114*a* of bolt 114 and an other end that engages an exhaust pipe 128 of the compressor 124.

The high-temperature and high-pressure coolant that has been sent from compressor 124 flows to the exhaust pipe 128, and its temperature generally is higher than the main compressor body. Heat conductive mechanism 30 transfers the heat of the exhaust pipe 128 to the center of the main bimetal 116 through the heat conductive member 32 and bolt 114.

Accordingly, the main bimetal 116 is supplied with heat from the exhaust pipe 128 through the heat conductive mechanism 30 in this embodiment, even after the electric current has been shut off with a result that even if the ambient temperature is low, the main bimetal 116 will retain heat longer and more closely reflect the temperature of the compressor. Accordingly, the main bimetal 116 goes back to the first position from the second position only after the temperature of the compressor 124 has been sufficiently lowered subsequent to the shut-off of the electric current. Consequently, excessive heating of the compressor 124 is prevented and at the same time, the wasteful repetition of the switch cycling is reduced thereby extending the life of the contact mechanism. The heat conductive mechanism 30 provides the same function as earlier described mechanism 20 with the difference being that in one case the heat is supplied from the compressor exhaust pipe, and in the other case the heat is supplied by the main compressor body.

FIG. 5 shows yet another heat conductive mechanism 40 which is connected to an intake pipe 130 of a compressor 124. That is, a heat conductor member 42 made of zinc-plated copper or the like has a first end that contacts intake pipe 130 and another end that contacts bolt protuberant part 114*a* of bolt 114. The intake pipe 130 receives coolant from an evaporator (not shown) at a temperature generally much lower than compressor body 124. As described earlier, bolt 114 is in direct heat transfer with main bimetal 116. The heat conductive mechanism 40 of FIG. 5 will tend to lower the temperature of bimetal 116, whereas the heat conductive mechanism 30 of FIG. 4 will tend to raise the temperature of bimetal 116. The use of these mechanisms allow for adjusting temperature input to bimetal from outside of casing 100.

In accordance with the present invention, both the main bimetal 116 and the auxiliary bimetal 12 can have the shape of a disk, a rectangular or any other shape. In the above embodiment, the movable contacts 118 and 120 are joined with the main bimetal 116. Additionally, the main bimetal 116 is electrically conductive at the time when the switch circuit is closed and conducts electricity thereby effecting self-heating. However, the movable contacts and the main bimetal 116 do not have to be integral; and the same may be constructed in such a fashion that at the time when the switch circuit is closed, the main bimetal 116 is not made electrically conductive but is heated only by the resistance heating of the resistance heater.

Also, in the aforementioned embodiment, the lower end 12*b* was displaced by using the upper end 12*a* of the auxiliary bimetal 12 as the fulcrum. However, the top and the bottom may be reversed with the upper end 12*a* being displaced and the lower end 12*b* being used as the fulcrum.

Still further, the switch circuit is not limited to a pair of contacts (108 and 118) and (110 and 120) as described above but also would include one contact part.

Although the above embodiment has been described as a protective device which is suitable for the protection of the motor of a sealed type freezer compressor, such overload protection device of this invention can also be used for the protection of other electric machines and electric apparatus.

Accordingly, it should be understood that although particular embodiments of this invention have been described by way of illustrating the invention, the invention includes all modifications and equivalencies of the disclosed embodiments falling within the scope of the appended claims.

I claim:

1. A protector for an electrical load comprising a housing, a fixed contact means contained within said housing which is electrically connected to said electrical load through a terminal means, a movable contact means contained within said housing positioned to make contact with said fixed contact means, a first bimetallic element capable of movement between a first position and a second position at a first action temperature in response to heat generated reflecting the electric current level that flows to said load, said first position being where said movable contact means engages said fixed contact means and said second position being where said movable contact means separates from said fixed contact means thereby opening the electrical connection between the protector and the load, and a second auxiliary snap-acting bimetal element capable of movement between a first position and a second position at a second higher action temperature than said first action temperature in the event said first bimetallic element fails to move from the first position to the second position, said first position being where said auxiliary bimetal member electrically connects said fixed contact means and said terminal means and said second position being where said auxiliary bimetal breaks electrical connection between said fixed contact means and said terminal means thereby opening the circuit between the protector and the load.

2. A protector as set forth in claim 1 further including a hold means to permanently hold said auxiliary bimetal member in said second position after it moves from said first position to said second position.

3. A protector as set forth in claim 2 wherein said hold means includes a thermoplastic member which softens at a temperature below said second higher action temperature so as to be able to hold said auxiliary bimetal member therein.

4. A protector as set forth in claim 3 wherein the temperature at which said thermoplastic member softens is at least equal to the first action temperature and greater than a snap action return temperature for said auxiliary disc.

5. A protector as set forth in claim 2 in which said hold means further includes one or more protrusions for better holding said auxiliary bimetal member.

6. A protector as set forth in claim 1 further including a heat conductive means to quickly conduct the heat from said load to said first bimetal member.

7. A protector as set forth in claim 6 in which said heat conductive means has a high coefficient of heat transfer and is in direct heat conductive relationship with both said load and said first bimetal member.

8. A protector as set forth in claim 7 wherein said heat conductive means is accessible external of said housing for easily adjusting temperature input to said first bimetal member.

9. A protector according to claim 6 wherein said heat conductive means is a high heat conductivity member that directly contacts the load at one part and at another part is in direct heat conductivity with said first bimetal member.

10. A protector for an electrical load comprising a housing, a fixed contact means contained within said housing which is electrically connected to said electrical load through a terminal means, a movable contact means contained within said housing positioned to make contact with said fixed contact means, a first bimetallic element capable of movement between a first position and a second position at a first action temperature in response to heat generated reflecting the electric current level that flows to said load, said first position being where said movable contact means engages said fixed contact means and said second position being where said movable contact means separates from said fixed contact means thereby opening the electrical connection between the protector and the load, a second auxiliary snap-acting bimetal element capable of movement between a first position and a second position at a second higher action temperature than said first action temperature in the event said first bimetallic element fails to move from the first position to the second position, said first position being where said auxiliary bimetal member electrically connects said fixed contact means and said terminal means and said second position being where said auxiliary bimetal breaks electrical connection between said fixed contact means and said terminal means thereby opening the circuit between the protector and the load, and a hold means to permanently hold said auxiliary bimetal member in said second position after it moves from said first position to said second position.

11. A protector as set forth in claim 10 wherein said hold means includes a thermoplastic member which softens at a temperature below said second higher action temperature so as to be able to hold said auxiliary bimetal member therein.

12. A protector as set forth in claim 11 wherein the temperature at which said thermoplastic member softens is at least equal to the first action temperature and greater than a snap action return temperature for said auxiliary disc.

13. A protector as set forth in claim 10 in which said hold means further includes one or more protrusions for better holding said auxiliary bimetal member.

* * * * *